United States Patent [19]

Marshall

[11] 3,972,039

[45] July 27, 1976

[54] ARTICLE REMOVAL AND PILFERAGE DETECTION SYSTEM AND APPARATUS

[76] Inventor: Steven Grant Marshall, 143 Village of Nagog Woods, Acton, Mass. 01718

[22] Filed: Mar. 14, 1974

[21] Appl. No.: 451,049

[52] U.S. Cl. ..... 340/280; 340/256; 340/409; 339/113 R; 339/37

[51] Int. Cl.[2] ..... G08B 21/00

[58] Field of Search ..... 340/280, 256, 420, 409, 340/253 R; 339/36, 37, 113 R, 113 B; 200/61.58 R

[56] References Cited

UNITED STATES PATENTS

| | | | |
|---|---|---|---|
| 3,253,270 | 5/1966 | Downer | 340/280 |
| 3,444.547 | 5/1969 | Surek | 340/280 |
| 3,781,857 | 12/1973 | Stendig | 340/280 |

*Primary Examiner*—John W. Caldwell
*Assistant Examiner*—William M. Wannisky
*Attorney, Agent, or Firm*—Jack Larsen; Gilbert L. Wells

[57] ABSTRACT

A three-wire alarm system is disclosed which features a plurality of plug-in strips each carrying a plurality of three-connector receptacles. These strips may be interconnected one to the next and to a battery-powered alarm box by identical jumper cables with three-pinned plugs. Other cables with identical plugs are fastened to valuable items which a merchant desires to display. When these items are placed on display, they are plugged into a nearby plug-in strip. The items may be plugged in without setting off the alarm; but removing any plug or cutting, shorting, or breaking the cables produces an alarm that can be turned off only with a key.

The three-contact receptacles of the invention contain a spring that (1) serves to interconnect two of contacts when the receptacle is not in use, (2) contacts the pin mating with the third contact when a plug is inserted, and (3) is dragged by that pin into contact with one of the other contacts when the plug is withdrawn thereby causing an alarm.

3 Claims, 12 Drawing Figures

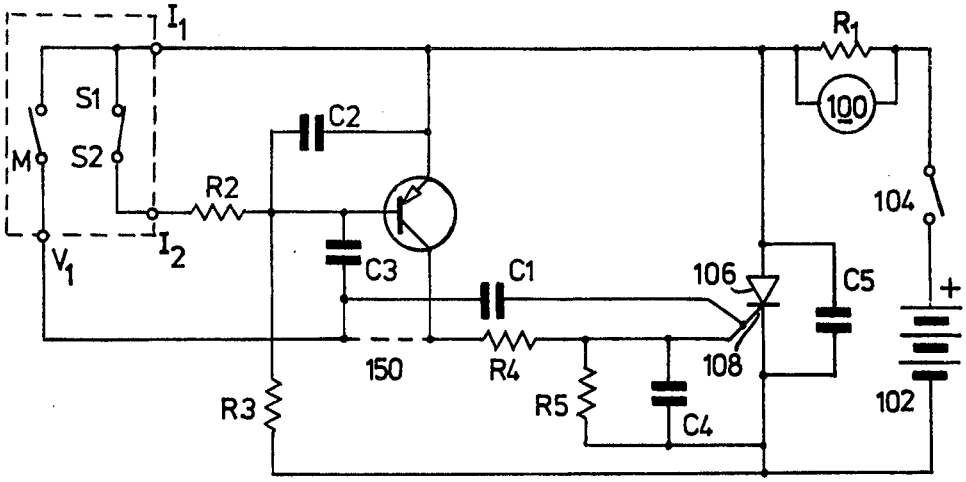
FIG. 3
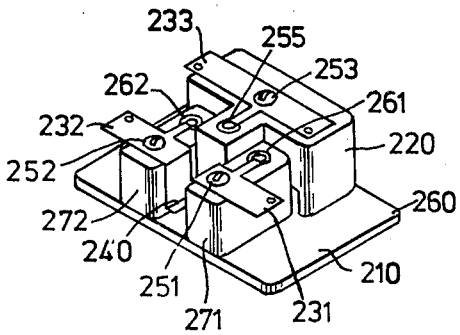
FIG. 4
FIG. 7
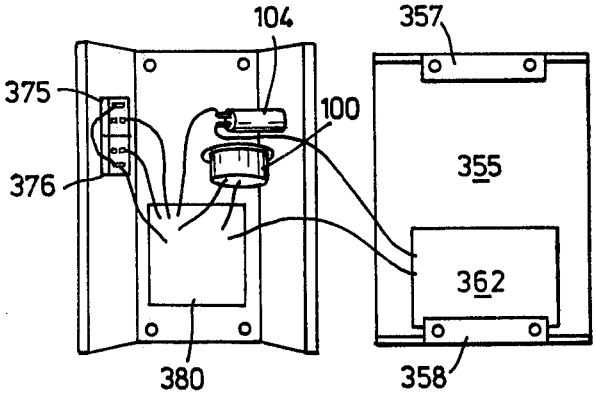

FIG. 5
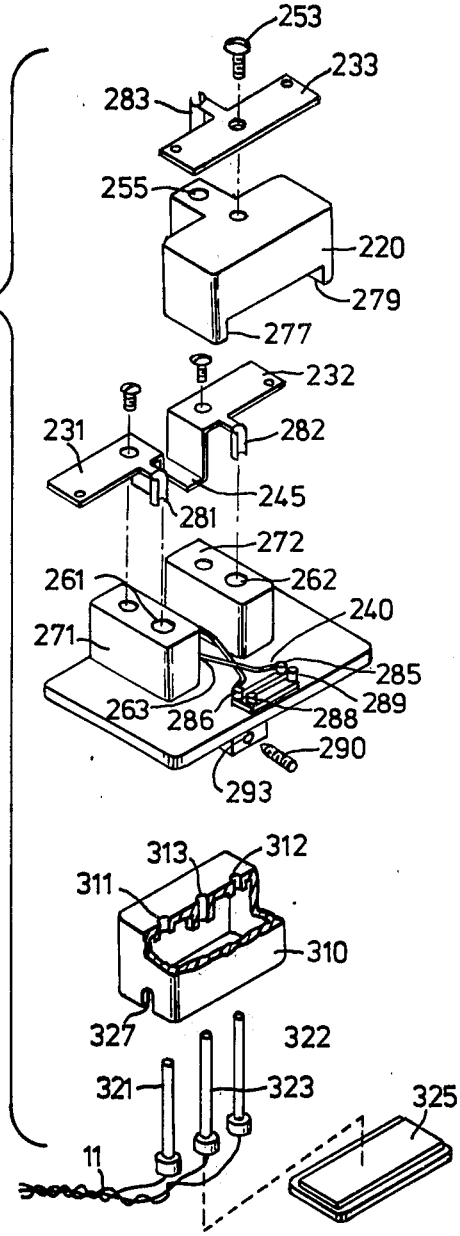
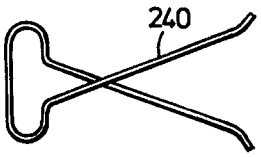
FIG. 5A
FIG. 5B
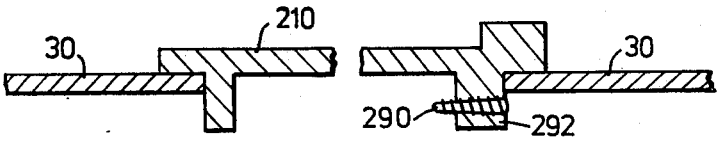

ARTICLE REMOVAL AND PILFERAGE DETECTION SYSTEM AND APPARATUS

This invention relates the general field of burglar alarms, and more particularly to apparatus to prevent and deter shoplifting.

It has been known to link a number of valuable items with an electrical conductor and to sound an alarm when the connection is broken, or its resistance changed. Systems of this general type are widely used to bridge the various doors and windows of a building.

The principal difficulty with such systems is that they can be defeated by a "jumper" consisting of a wire with clips at each end, which is connected at each side before the conductor is cut.

It is a feature of the present invention that the breaking of a circuit produces an alarm as with the known devices, but a further wire which produces an alarm when shorted to one of the others is twisted with the indistinguishable from the other two, making jumping more hazardous to a potential thief.

Another feature of the invention is a novel connector by which it is possible to add items for protection without shutting off the protection, but which may not be withdrawn without an alarm.

Other features and advantages of the invention will in part be obvious and in part apprehended from the following specification taken in conjunction with the accompanying drawings of which FIG. 1 is a view of apparatus of the invention generally as arranged for use;

FIG. 3 is a schematic diagram for the preferred embodiment of the alarm box of FIG. 1;

FIG. 4 is an isometric drawing of the interior of one of the novel electrical receptacles of the invention;

FIG. 5 is an exploded view of the connector of FIG. 4;

FIG. 5A is a plan for the contact spring of FIG. 5;

FIG. 5B is a section through part of the connector of FIG. 4;

FIG. 7 is a view of the alarm box of FIG. 1 opened for servicing.

Figure 1:
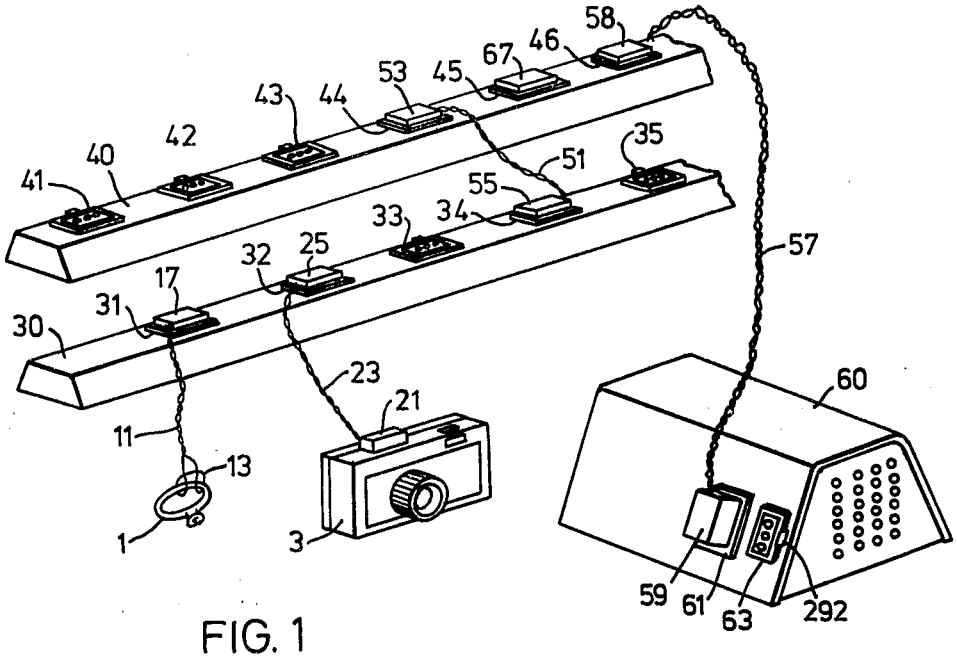

FIG. 1 shows an arrangement of the invention as it might be employed to protect a number of valuable items which a merchant desires to display in a manner which would protect these items from theft, and yet allow the customer to handle and try the item as may be appropriate. For purposes of this specification we will refer to these items of value generally as "treasures". The treasures shown in FIG. 1 as examples are a finger ring 1, and a camera 3. The number of such items which may be controlled by a single system might be in the hundreds, if desired.

The ring 1 is fastened by a girth hitch to the cable 11 which has an eye 13 at one end and a plug 17 at the other end. The camera 3 has affixed to it a switch 21 from which a cable 23 extends to a plug 25. The plugs 17 and 25 secure the treasures to a strip 30 by engaging receptacles 31 and 32 respectively which are typical of the receptacles 31–39 of the strip 30, which may have any convenient number of receptacles.

Another strip 40 having receptacles 41–49 may be linked to the strip 30 by a jumper cable 51 having plugs 53 and 55. The strip 40 is also connected through a jumper cable 57 and plugs 58 and 59 to an alarm box 60. The alarm box contains batteries (not shown) and a buzzer 100 (FIG. 3, 7). A convenient number of receptacles, 61, 63, are provided which may be connected to a treasure or through a jumper cable to a plug-in strip. Any number of strips may thus be included in the distribution means.

The circuitry is so arranged that additional treasures may be attached to the system by plugging their connecting cables into any of the unoccupied receptacles. No alarm results, in the preferred embodiment, when additional treasures are added, but an alarm sounds if and when any of the plugs is removed, and an alarm will almost certainly sound if any cable is cut, shorted, or broken. To attain this result, it is necessary that the special switching operations associated with each receptacle are working properly, when a receptacle is misfunctioning. A jumper plug 67 may be used to occupy a defective receptacle and prevent a false alarm being caused by it.

Figure 2:
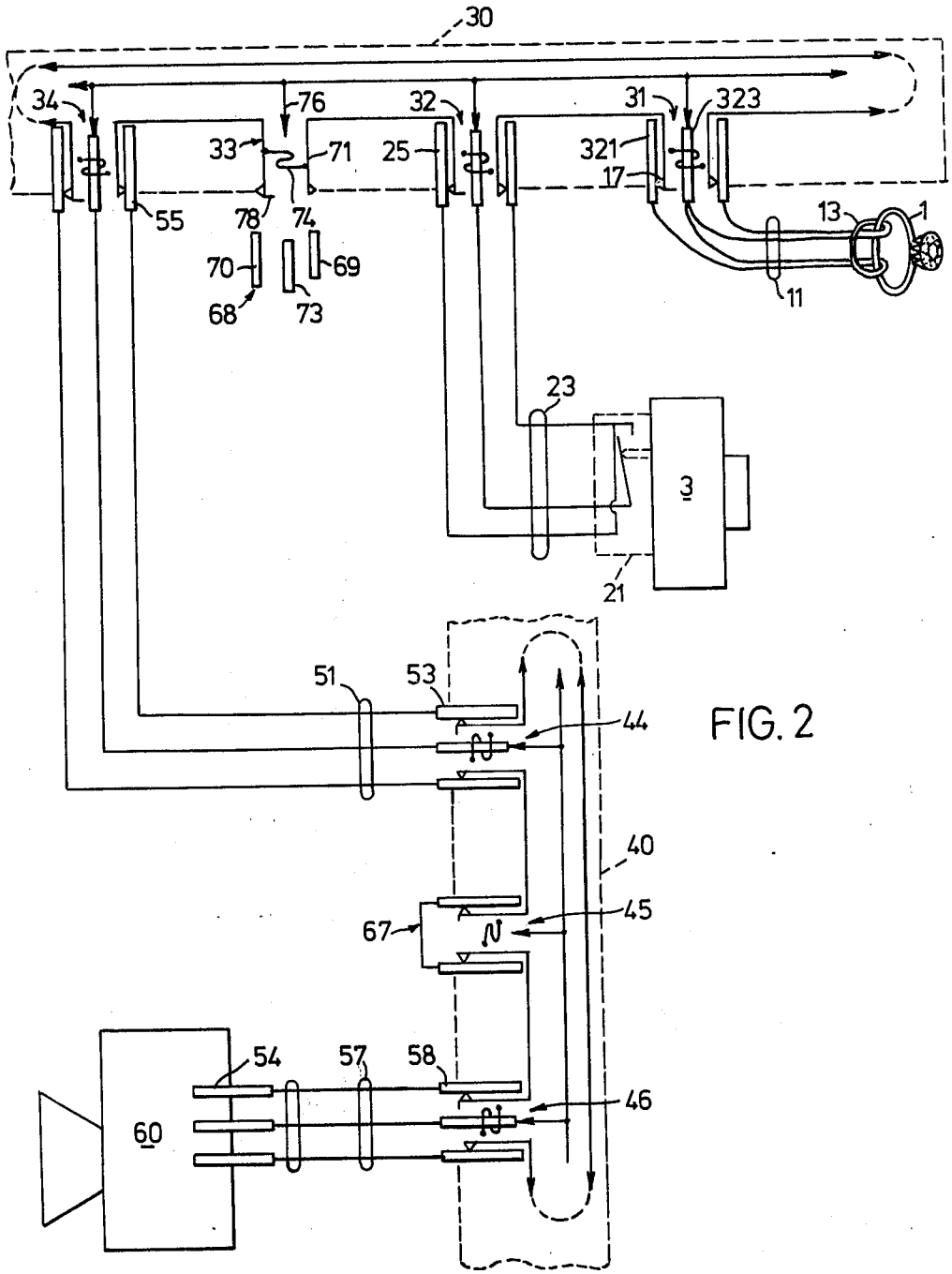
FIG. 2 is a schematic diagram of the arrangement of FIG. 1.

FIG. 2 ia a schematic diagram illustrating the mode of operation of the apparatus. The receptacle 33 is indicated as unoccupied. It is ready to receive a plug 68 having a pair of contacts or pins 69 and 70 to engage the pair of contacts 71 and 72 respectively of the receptacle 33. A spring 74 is situated between these contacts 71 and 72 and bridges them; but is formed so that when the pin 73 (which is the third contact of the plug) is inserted, the spring 74 is wedged away from the contacts 71 and 72 after they have been engaged by their longer mating pins. The pin 73 which has displaced the spring from the contacts 71 and 72 then meets the contact 76 to complete the connection. When the plug is withdrawn, the spring 74 moves with the pin 73 and its end touches the finger 78 on the contact 72. Each of the receptacles 31–39, 41–49, 61, 63 is substantially identical to each of the others, having springs to maintain the connection between two of the contacts (which may be termed "current contacts") and having a "voltage contact", the current contacts being connected in series, and the voltage contacts being connected in parallel in each plug-in strip, and in any receptacles which may be part of the alarm box. The alarm box is made sensitive to change in a predetermined small current which normally flows to the voltage contacts or a predetermined change in the normally small potential drop across the current contacts.

When a plug is inserted in any of the receptacles, an alarm will sound unless the continuity of current is maintained through the current contacts, and unless the isolation of the voltage contacts is maintained, to the degree of sophistication that the user desires. In the simplest embodiment, a minimum resistance is maintained in the circuit through the current contacts, while the alarm box is made sensitive to a shorting of the voltage contact line to one of the wires of the current circuit.

FIG. 3 is a schematic diagram of the preferred embodiment of the alarm box. A buzzer 100 is operable by current from a pair of dry cells 102 passing through a key-locked switch 104 and a silicon-controlled rectifier (SCR) 106. The gate 108 of the SCR is coupled through a capacitor C1 to the voltage contact V1 of the receptacle 61, 63 of the alarm box. Thus the SCR 106 is triggered when the voltage terminal is shorted to one of the current terminals I1 and I2.

The current through the circuit of current contacts flows from the battery 102, the buzzer 100, resistor R1 out through one current contact I1, around the circuit through the plug-in strips and at least one run of the connecting cable to a receptacle for a treasure and back through the run of cable and the other current contact I2, thence through a hash filter made up of a resistor R2 and capacitor C2 to the base of a transistor amplifier T1 and through a resistor R3 to the battery return. The resistor R3 has a high resistance to limit the current drawn to a fraction of a milliampere. It insures that the transistor T1 is turned "on" when the circuit between contacts I1 and I2 is opened. The collector of the transistor is connected through a small resistance R4 to the SCR gate, thereby to trigger the SCR when the circuit through the current contacts is broken. Since the operating principles of the invention will be publicly known when this patent is issued, and may earlier be deduced of obtained in other ways, there is the possibility that a potential thief, might probe the cables with an electronic voltmeter or ohmmeter and attempt to connect the contact to a battery voltage, thereby disabling the circuit. The capacitor C3 is connected between the voltage terminal and the transistor gate thereby to make the alarm responsive to abrupt changes in the potential of the voltage terminal whether of one polarity or the other.

For simplicity, only one receptacle is shown in the alarm box schematic of FIG. 3. The preferred values of the parts indicated in the circuit of FIG. 3 are as follows:

Table I

| | |
|---|---|
| R1 270 ohms | C1 0.2 microfarads |
| R2 1000 ohms | C2 0.2 microfarads |
| R3 47,000 ohms | C3 1 microfarad |
| R4 1,000 ohms | C4 0.2 microfarads |
| R5 1,000 ohms | C5 0.2 microfarads |
| Buzzer is bicycle buzzer | 0.4 ohms |

FIG. 4 shows the preferred embodiment of a receptacle for use in the invention. The receptacle comprises a base 210, a bridge 220, three contact elements 231,232, and 233, an X-spring 240, and three mounting screws 251, 252, and 253.

The base 210 has a generally flat plate portion 260, which faces outward toward the user presenting on the side not shown three holes 261, 262, and 263 which are centered, in-line, and are spaced apart by somewhat less than one-quarter-inch on centers. The holes are between one-sixteenth and one-eigth inch in diameter. These holes are surrounded by a barrier (not shown) to prevent a knife of other instrument to contact the pins of a mating connector. A set screw is also fixed to the barrier to be seated against a plug so that it will not be withdrawn "accidently".

Upstanding around the outer two holes 261 and 262 are socket bodies 271 and 272 to contain and support the two current contact elements 231 and 232 respectively. These parts cut initially in a generally T shape are fastened to the rearmost (uppermost as shown) face of the socket bodies by the screws 251 and 252 respectively which engage holes formed in the bodies parallel to the socket holes. These screws engage the T at the intersection of the "tree" and the "arms". The tree is bent and formed to provide a pin-contacting sleeve portion within the enlarged upper end of one of the socket holes. The outermost arm of each of the current contact elements provides a point of attachment for circuit wiring and is termed the solder arm, while the innermost arm called the contact arm is bent along the side of the socket body on which it is carried so that it may there be contacted by one of the toe ends of the X-spring 240. The X-spring is supported on the base parallel to the surface thereof as on pins molded intergral therewith and extending outward from the base as will be more clearly seen in connection with FIG. 5. The finger 245 extends inwardly from the end of the contact arm of element 232. The socket body for the third socket is integral with the bridge 220 and supports the pin-contacting sleeve portion of the contact 233 in the socket hole 255 which is spaced apart from the base 210 being supported there by legs 277 and 279 (see FIG. 5) of the bridge 220 which are not shown in FIG. 4 and by cementing the socket body of the bridge between the socket bodies 271 and 272. The voltage contact 233 is retained by a screw 253 driven into the bridge 220. Both arms of the T are available for making circuit connections.

FIG. 5 is an exploded view of the receptacle of FIG. 4 but with the parts rotated to show portions hidden in FIG. 4.

The sleeve portions of contact elements 231,232, and 233 are shown respectively at 281, 282, and 283. The X-spring 240 is seen to be formed around pins 285 and 286 and held in place by pins 288 and 289 with the crossing of the X bringing both legs of the X-spring in line with the holes 263, 255 so that a plug pin passing through the hole 263 to engage the contact protion 283 will first deflect the legs of the X-spring to lit its toes from contact with the contact arms parts 231 and 232.

A set screw 290 screws through a hole in the boss 292 on the barrier 293 (FIG. 5B) to engage the body 310 of a plug, of the type of the plug 17 of FIG. 1. The body 310 is in the form of an open-topped box with the holes 311,312, and 313 in the bottom, through which pins 321, 322, and 323, respectively are pressed. Prior to pressing the pins into the body, the wires of cable 11 are soldered to the pins 321, 322,323. The pins 321 and 322 in contact with the current contacts are connected one to the other through the cable, while a second strand of the cable is soldered at both of its ends to the pin 323. The outer pins 321 and 322 are pressed as far as possible into the plug body, while the middle pin 323 is pressed in to extend by a lesser length, but sufficiently to permit the cover 325 to be cemented to the body 310 thereby to complete the assembly of the plug. The cable emerges through a small notch 327 at the end of the body 310.

The confirmation of the X-spring 240 is shown in the detail FIG. 5A. It has been found satisfactory to employ 0.020 inch diameter stainless-steel wire to form the spring which measures, as formed 0.40 inches wide and three-fourth inch long.

Figure 6:
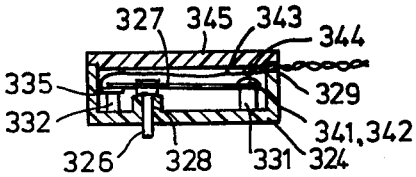
FIG. 6 is a sectional view indicating the operation of a terminating switch as shown in FIG. 1.

FIG. 5B is a section through the face of the receptacle. The receptacle mounts into a hole cut in the strip 30 so that a barrier rib 293 reaches through and fits closely around an inserted plug so that a knife or the like may not be slipped between plug and receptacle to contact the pins 321,322,323. The set screw 290 passes through an enlargement of the barrier, the boss 292. FIG. 6 is a somewhat schematized cut-away view of the switch of FIG. 1 The switch has a body 321 in the form of an open-topped box with a hole 323 in the bottom through which an actuating pin 325 extends. The head end of the pin 325 engages the free end of a spring wire 327 which is anchored at its other end to a bench 331 in a corner of the box. The wire 327 and the connecting wires 341, 342 are preferably crimped in a connector lug 329 which is fixed to the bench 331. The third connecting wire 343 is crimped in another connector lug 335 which is fixed to a post 332 and serves as the point to which the wire 327 makes contact when not held away by the pin 325. Connecting wires 341,342, and 343 are anchored to a post 344 and also retained by crimping as mentioned above.

Figure 6A:
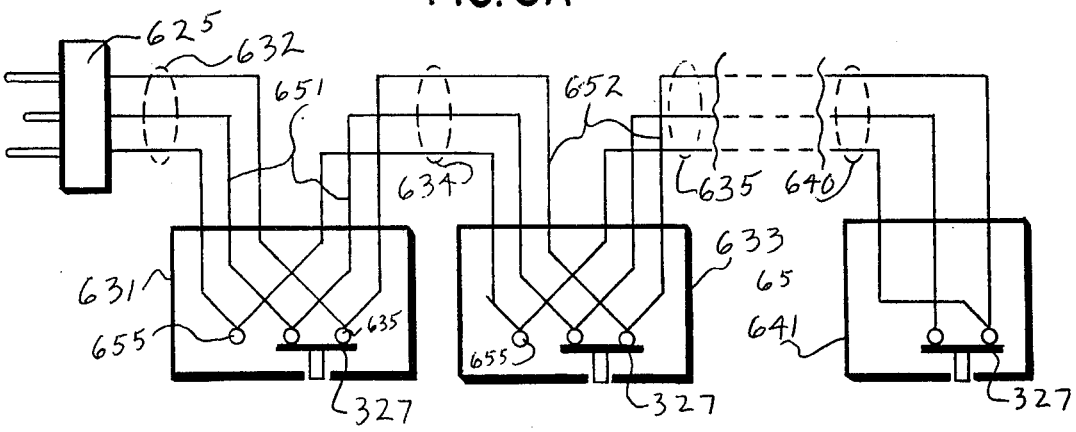
FIG. 6A is a schematic diagram for a multi-pad cable.

FIG. 6A is a schematic diagram for a cord with which a number of small items may be interconnected and fixed to a single cord and plug 625. A first switch 631 is connected to the plug 625 by a length 632 of three-conductor cable, and to the next switch 633 by a second length 634 of cable, in turn, the switch 633 is also connected by a length 635 of cable to the next switch in line, which is not shown, until a final length 640 of cable connects the next-to-last switch (not shown) to the endmost switch 641.

Figure 6B:
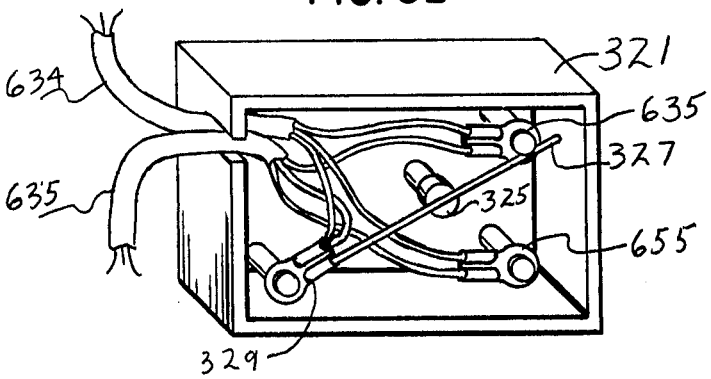
FIG. 6B is a plan view showing the interconnections within each of the intermediate pad switches of FIG. 6A.
Figure 6C:
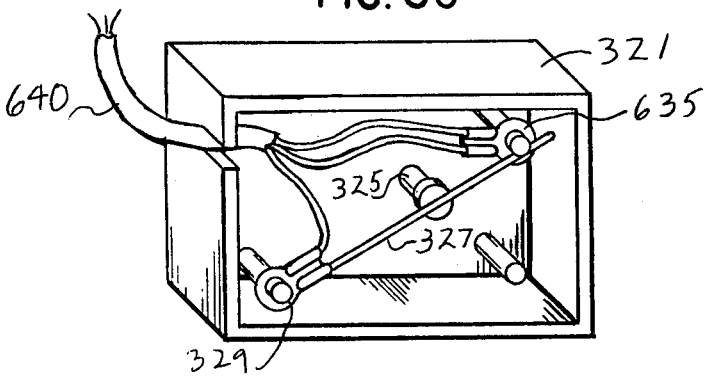
FIG. 6C is a plan view showing the interconnections for the endmost switch pad of the cable of FIG. 6A.

In the wiring of the switches, the successive lengths 632,634 . . . 640 are interconnected to establish a first circuit 651 which interconnects all of the spring wires 327 by crimping together two wires making up successive portions of the circuit 651 with each of the spring wires 327 save for the endmost switch wherein there is only the one wire in the length 640 which is the last in the circuit 651 to crimp with the spring 327. In like manner a second circuit 652 is established between the plug 625 and each of the switches by crimping together in the connector lugs 635 the two wires which are the corresponding members of successive lengths 632,634 . . . 640 of cable. A third circuit 653 is established between the plug 625 and each of the switches 631,633 . . . 641 by joining at each of the intermediate switches 631,633 . . . (excluding 641) by crimping together in a third connector lug 655 as shown in FIG. 6B in each of the intermediate switches the remaining corresponding members of the successive lengths of cable. In the endmost switch 641 the ends of the second and third circuit are crimped together at the lug 635 as shown in FIGS. 6 and 6C.

FIG. 7 shows the alarm box opened up. The box is made of two pieces of heavy metal bent as shown. The base 355 has two ends bent up and perforated, with ears 357 and 358 formed at the top and drilled to accept four blind rivets (not shown) by which the top 360 is fastened to complete the enclosure. There is a door in the bottom (now shown) by which dry cells may be replaced in a battery compartment 370.

Fastened to the top are a pair of receptacles 375 and 376. At the back is a key-operated switch 104. A bicycle buzzer 100 is mounted transversely to radiate out of the performations at the ends of the enclosure. The remainder of the electronic circuitry as represented by FIG. 3 is encapsulated and cemented to the top at 380.

Although the Patent Laws require that the preferred embodiment be disclosed in this specification, it should be pointed out that in another sense, the preferred embodiment is that there should be no preferred embodiment. While the apparatus as described is secure against the thief who would rip out or cut the wires, a person skilled in the art may readily devise means and instruments by which any of the specific embodiments disclosed may be fooled or disabled. On the other hand, variations in the disclosed circuitry may be devised so that the elementary means which may be employed to defeat one embodiment would serve to triger a more sophisticated arrangement. It is, therefore preferred that a number of such variations be manufactured and used on a random basis. These varied systems would all look alike so that a thief could never be sure whether he was encountering a simple or a more complex system.

FIG. 3 represents three variations of the electronics which require different countermeasures. The simplest arrangement would be obtained by connecting the voltage input $V_1$ directly to the gate 106 of the SCR through the resistor R4 as indicated by the dotted line 150, removing from the circuit the capacitors C1 and C3. This is the simplest circuit, and for that reason is preferred. In another arrangement, the capacitor C3 might be restored to make the circuit sensitive to a voltage probe.

In another variation, each connecting cable for a treasure is arranged to introduce a predetermined resistance in the current circuit, and to have a shunt resistance to draw a predetermined current from the voltage contact, so that as additional treasures are added to the system the ratio of the voltage across the current circuit, to the current through the voltage terminal remains substantially constant. The alarm is made responsive to a nontransient change in this ratio. Other variations include the use of alternating currents and voltages of various frequencies, and mixtures of alternating and direct currents and voltages. The number of permutations and combinations of these variations will be seen to be very great, imposing an very formidable obstacle to a thief. Moveover a thief attempting to guess at the arrangement he faces would be taking a substantial and, therefore probably unacceptable risk of detection.

In this connection it may be noted that systems have long been known in the prior art wherein valuables have been protected from theft by alarms responsive to the breaking of a circuit of wire carried through the item, or by a switch attached to the item. Bridge circuits balanced to respond to any change in circuit resistance have likewise been known. It is not known that a three-wire system as shown has been heretofore adapted to this service. Given that there is a three-wire distribution system as shown in FIG. 2 it is possible for the individual detectors to the two-wire connected, where that is convenient. The thief could not by observation known which two wires were used so that an even chance of detection would result if he chose to short or to cut the connecting wires.

It will also be obvious that this system may be employed with detectors of fire or malfunction where no countermeasures features are required.

In another modification the alarm would be silent, emitting a radio or ultrasonic signal with signal transmitters well known in the art.

Switches of the type shown in FIG. 6 may be fixed to the treasures by use of various adhesive compositions. Modern adhesives are available to provide a quick and strong bond where that is permissible; but usually, a bond is desired that is strong enough to resist accidental displacement, defeat with a knife, and the like, yet which can be easily removed without damage to the treasure.

I have found a double-faced adhesive tape manufactured by 3M Co. and designated by them as "Scotchnant Y9122" to be satisfactory. A good bond is formed instantly, and improves with age.

The embodiments of the invention in which an exclusive property or privilege is claimed are defined as follows:

1. An alarm system to respond to the removal of a treasure from its assigned place, comprising:

a. an indicator subsystem containing a signal transmitter;

b. distributing means including at least three runs of wire extending from said subsystem to said treasure, and terminations of said runs such that a circuit of current is maintained from said subsystem outward along a first of said runs, and back to said subsystem along a second of said runs, and such that said third run extends with at least one of said other runs and is isolated therefrom to maintain a predetermined potential difference;

c. wherein said subsystem incudes detection circuit means so connected that cutting said circuit causes said transmitter to transmit an alarm, and so that making an electrical connection between said third run and said circuit even momentarily causes said transmitter to transmit an alarm;

d. said subsystem comprises a plug-in strip;

e. said strip comprising a plurality of identical connector receptacles;

f. each of said receptacles having three sockets for mating plug having three pins;

g. each of said receptacles having a spring to maintain the interconnection of two of said sockets until said pins are inserted, said spring being deflected by the outward motion of one of said pins upon withdrawal to make connection between one of said two and the third of said sockets;

h. wherein each of said two sockets is electrically connected to one and only one of said two sockets of another of said receptacles; and i. wherein all of said third sockets are electrically interconnected each to all of the others.

2. A system as defined by claim 1 j. having a plurality of said strips, and k. wherein one of said strips is connected to another of said strips by a jumper cable, l. said jumper cable comprising a pair of said mating plugs, the pin of one of said plugs adapted to mate with one of said third sockets, being linked by a length of wire to the other pin of said pair adapted to mate with the third socket.

3. The system as defined by claim 1 j. wherein said subsystem comprises a sturdy protective box containing said signal transmitter and its operating source of energy, k. said strip is connected to said box and said signal transmitter by a box connector receptacle in said box, l. said box receptacle connector being of the same construction of said identical receptacles, and by a jumper cable, said jumper cable comprising a pair of said mating plugs, the pin of one of said plugs adapted to mate with one of said third sockets being interconnected to the pin of said other plug of said pair adapted to mate with another of said third sockets.

* * * * *